US011371523B2

(12) United States Patent
Lin

(10) Patent No.: US 11,371,523 B2
(45) Date of Patent: Jun. 28, 2022

(54) DETACHMENT MECHANISM FOR FAN

(71) Applicant: CHANG TJER MACHINERY CO., LTD., Taichung (TW)

(72) Inventor: Yu-Tse Lin, Taichung (TW)

(73) Assignee: Chang Tjer Machinery Co., Ltd., Taichung (TW)

( * ) Notice: Subject to any disclaimer, the term of this patent is extended or adjusted under 35 U.S.C. 154(b) by 46 days.

(21) Appl. No.: 16/884,720

(22) Filed: May 27, 2020

(65) Prior Publication Data

US 2021/0372423 A1 Dec. 2, 2021

(51) Int. Cl.
*F04D 29/28* (2006.01)
*F04D 17/08* (2006.01)

(52) U.S. Cl.
CPC ..... *F04D 29/281* (2013.01); *F04D 17/08* (2013.01); *F05B 2240/20* (2013.01)

(58) Field of Classification Search
CPC .... F04D 29/166; F04D 17/162; F04D 29/263; F04D 29/30; F04D 29/281; F04D 17/08; F05B 2240/20; B25B 27/023; B25B 27/02; B25B 27/062; Y10T 29/53796
See application file for complete search history.

(56) References Cited

U.S. PATENT DOCUMENTS 2,312,931 A * 3/1943 Rhoads ..... B61K 11/00 105/113
3,748,718 A * 7/1973 Russell ..... B25B 27/023 29/283
6,305,061 B1 * 10/2001 King ..... B25B 27/023 29/259
2015/0121675 A1 * 5/2015 Campoli ..... B25B 27/0035 29/426.5
2017/0130715 A1 * 5/2017 Drysdale ..... F04C 15/0073

* cited by examiner

*Primary Examiner* — Eric J Zamora Alvarez
(74) *Attorney, Agent, or Firm* — Muncy, Geissler, Olds & Lowe, P.C.

(57) ABSTRACT

A detachment mechanism for a fan is provided for being adapted for a fan structure, the fan structure includes a rotating axle and a blade assembly, the blade assembly is sleeved on the rotating axle, and the detachment mechanism for the fan includes a detachment threaded hole. The detachment threaded hole is configured for a detachment bolt to be rotatably screwed therewith, the detachment threaded hole penetrates through the detachment mechanism for the fan, and a part of the rotating axle is exposed from an opening area of the detachment threaded hole.

8 Claims, 9 Drawing Sheets

DETACHMENT MECHANISM FOR FAN

BACKGROUND OF THE INVENTION

Field of the Invention

The present invention relates to a detachment mechanism for a fan, a usage of the detachment mechanism for the fan and a fan structure including the detachment mechanism for the fan.

Description of the Prior Art

Generally, a fan structure includes a blade assembly and a rotating axle, and the blade assembly and the rotating axle usually have an anti-loose structure therebetween or are tight-fit to prevent the blade assembly from being detached from the rotating axle during operation. It is understandable that when a user wants to replace the blade assembly, s/he has to use a specialized detachment device such as a gear puller.

However, it is difficult and time-consuming to assemble the gear puller, so the user cannot disassemble the gear puller smoothly. In addition, the user has to spend money to purchase the gear puller which matches the dimension of the blade assembly to be replaced, so there will be extra cost.

The present invention has arisen to mitigate and/or obviate the afore-described disadvantages.

SUMMARY OF THE INVENTION

The major object of the present invention is to provide a detachment mechanism for a fan which is a part of a fan structure, and during a disassembling process, the detachment mechanism for the fan can help a user to quickly detach the blade assembly from a rotating axle.

To achieve the above and other objects, a detachment mechanism for a fan is provided, including a rotating axle and a blade assembly, the rotating axle defines an extension direction, the blade assembly is detachably sleeved on the rotating axle, the blade assembly and the rotating axle are in a co-rotation relationship, the detachment mechanism for the fan is positionably connected to the blade assembly and covers a part of the rotating axle, the detachment mechanism for the fan includes a detachment threaded hole, the detachment threaded hole is configured for a detachment bolt to be rotatably screwed therewith, the detachment threaded hole penetrates through the detachment mechanism for the fan along the extension direction, a part of the rotating axle is exposed from an opening area of the detachment threaded hole; wherein, when the detachment bolt is screwed with the detachment threaded hole and abutted against the rotating axle and the blade assembly is kept in a non-rotating state, the detachment bolt is driven to rotate continuously in a detachment direction, the detachment mechanism for the fan moves along a direction in which the detachment bolt moves away from the rotating axle, and the blade assembly is driven to be detached from the rotating axle.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
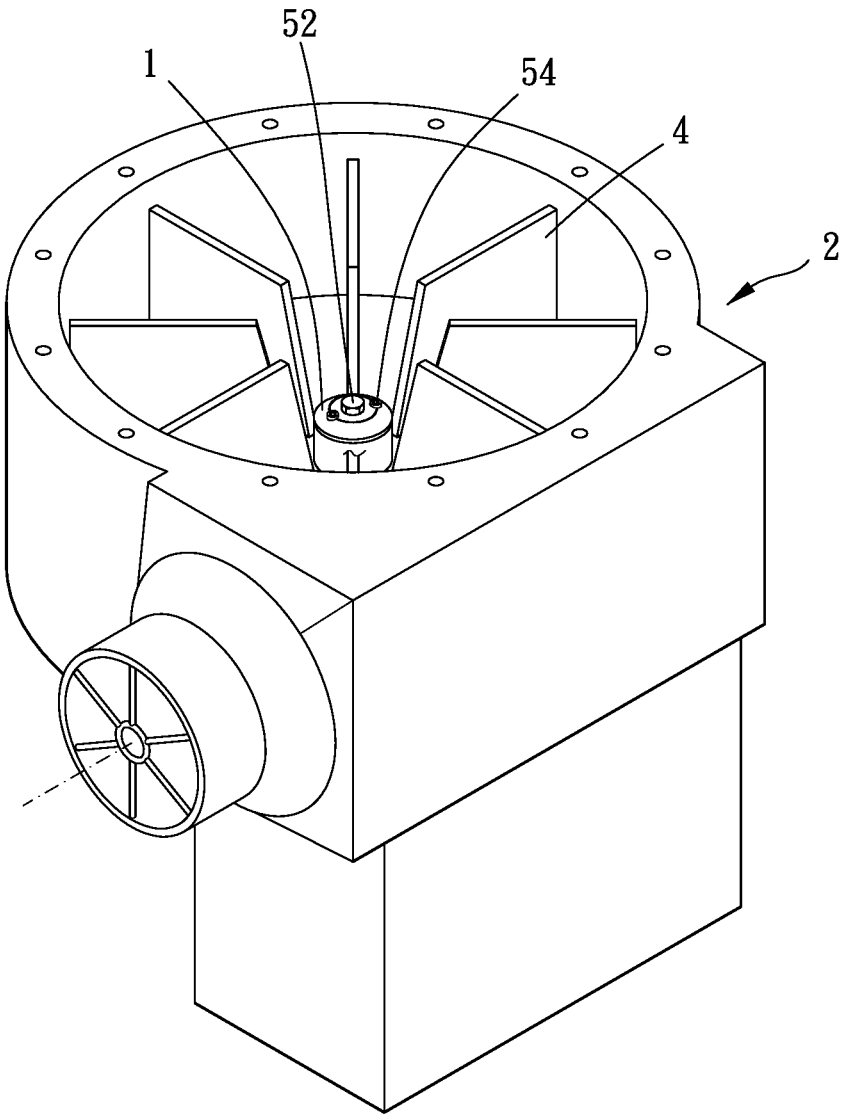
FIG. 1 is a stereogram of an embodiment of the present invention.
Figure 2:
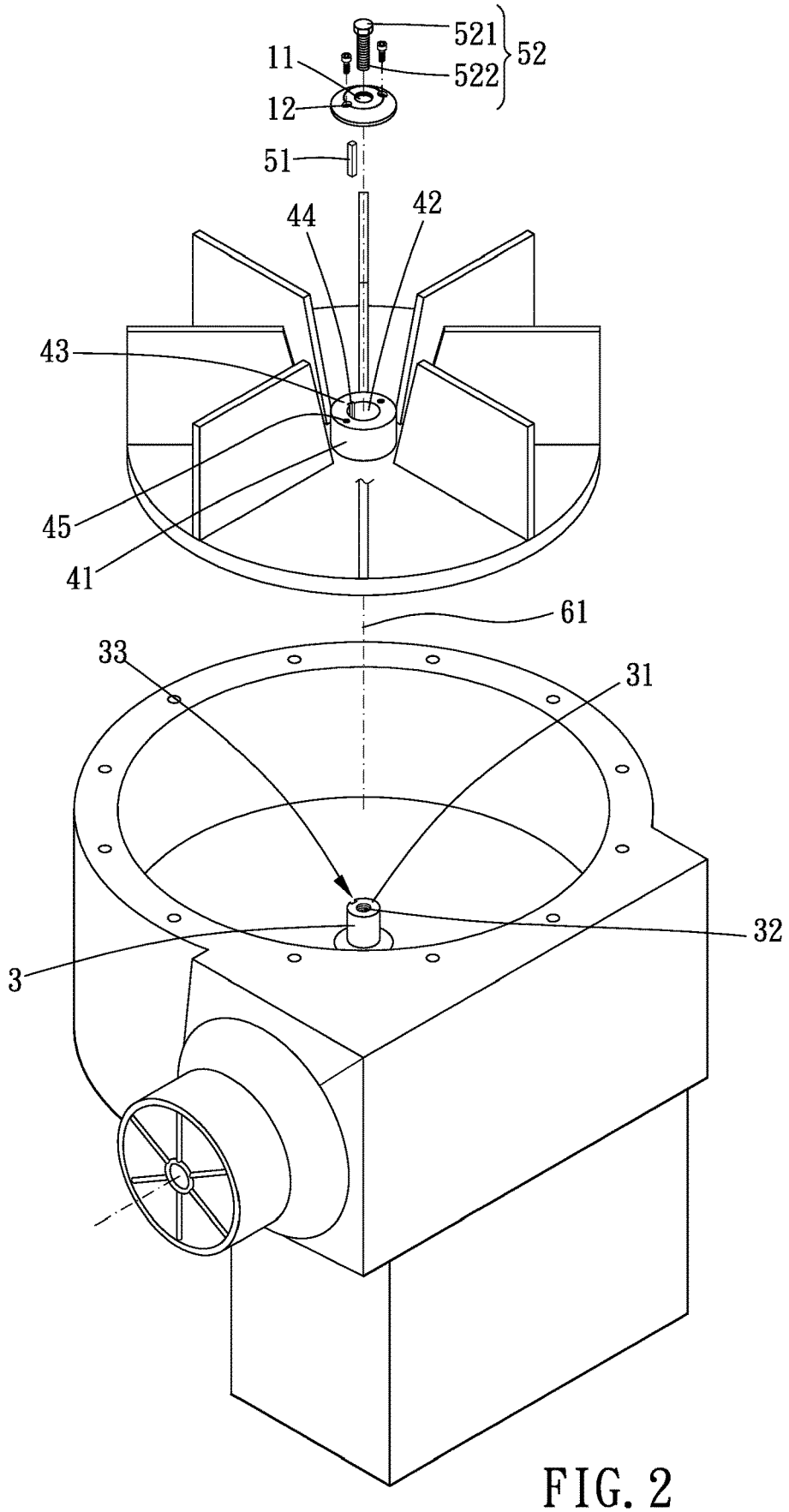
FIG. 2 is a breakdown view of FIG. 1.
Figure 3:
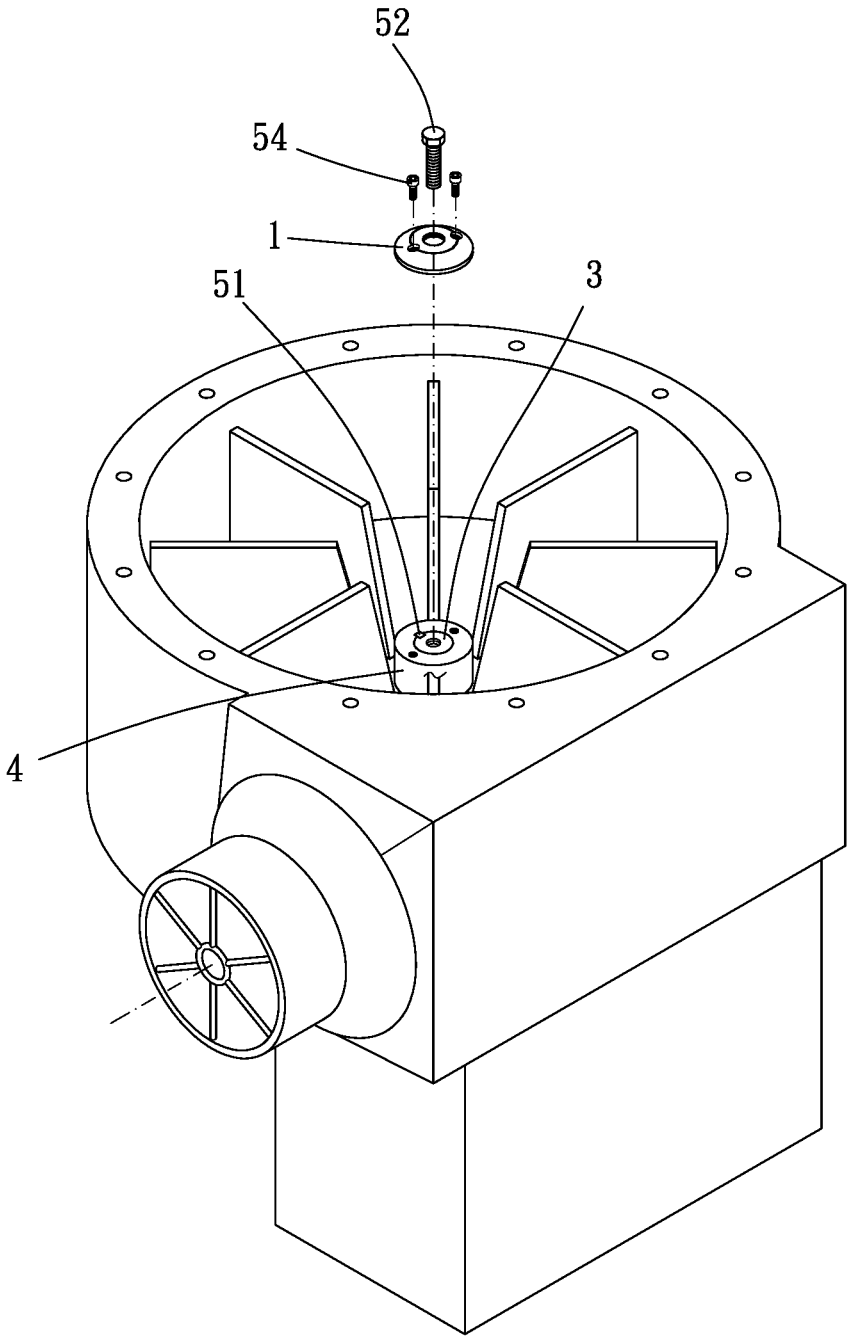
FIG. 3 is a partially breakdown view of FIG. 1.
Figure 4:
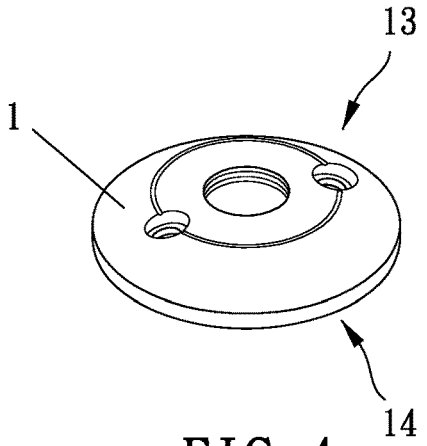
FIG. 4 is a stereogram of a detachment mechanism for a fan of the embodiment of the present invention.
Figure 5:
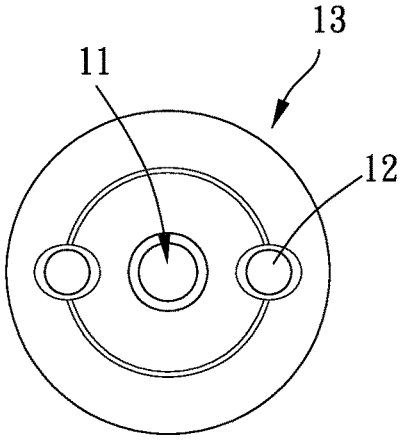
FIG. 5 is a top view of FIG. 4.
Figure 6:
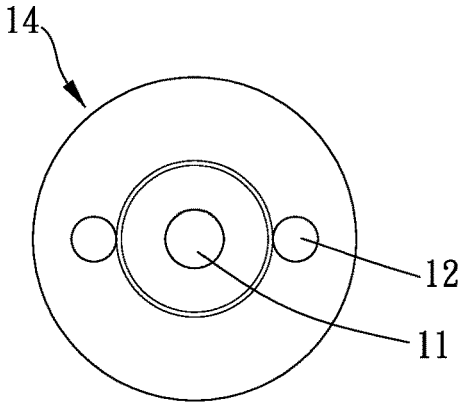
FIG. 6 is a bottom view of FIG. 4.
Figure 7:
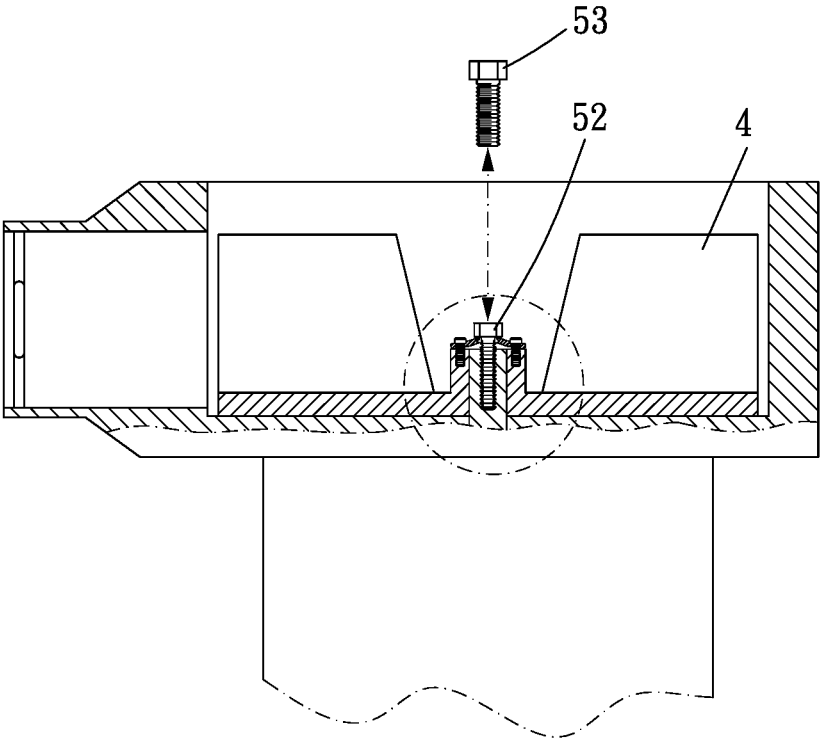
FIG. 7 is a drawing showing a blade assembly being assembled to a rotating axle of the embodiment of the present invention.
Figure 8:
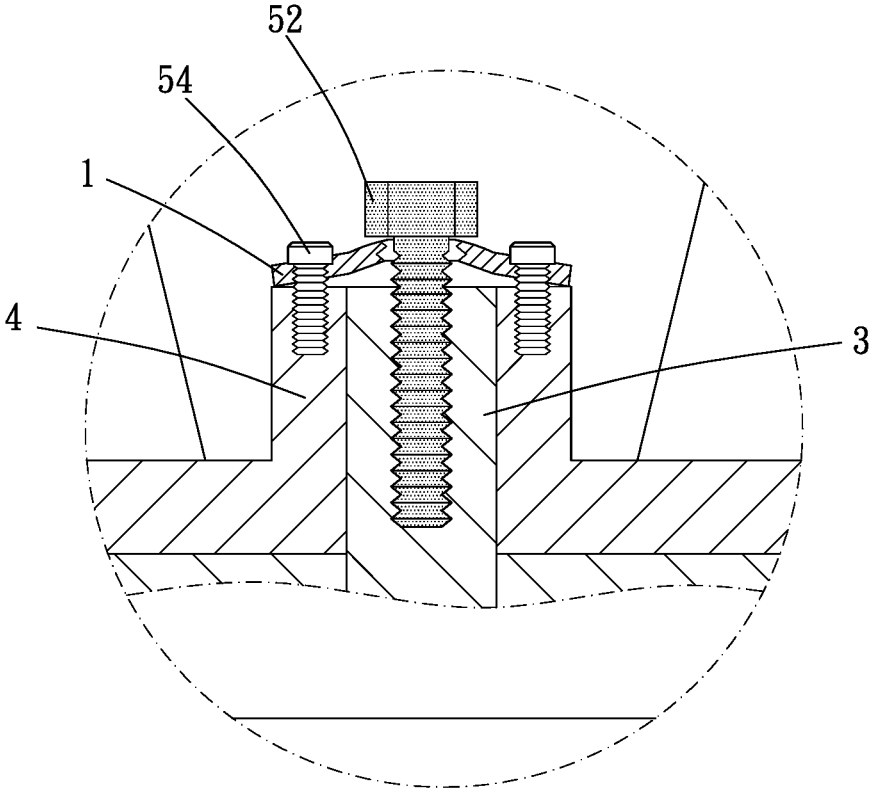
FIG. 8 is a partially-enlarged view of FIG. 7.
Figure 9:
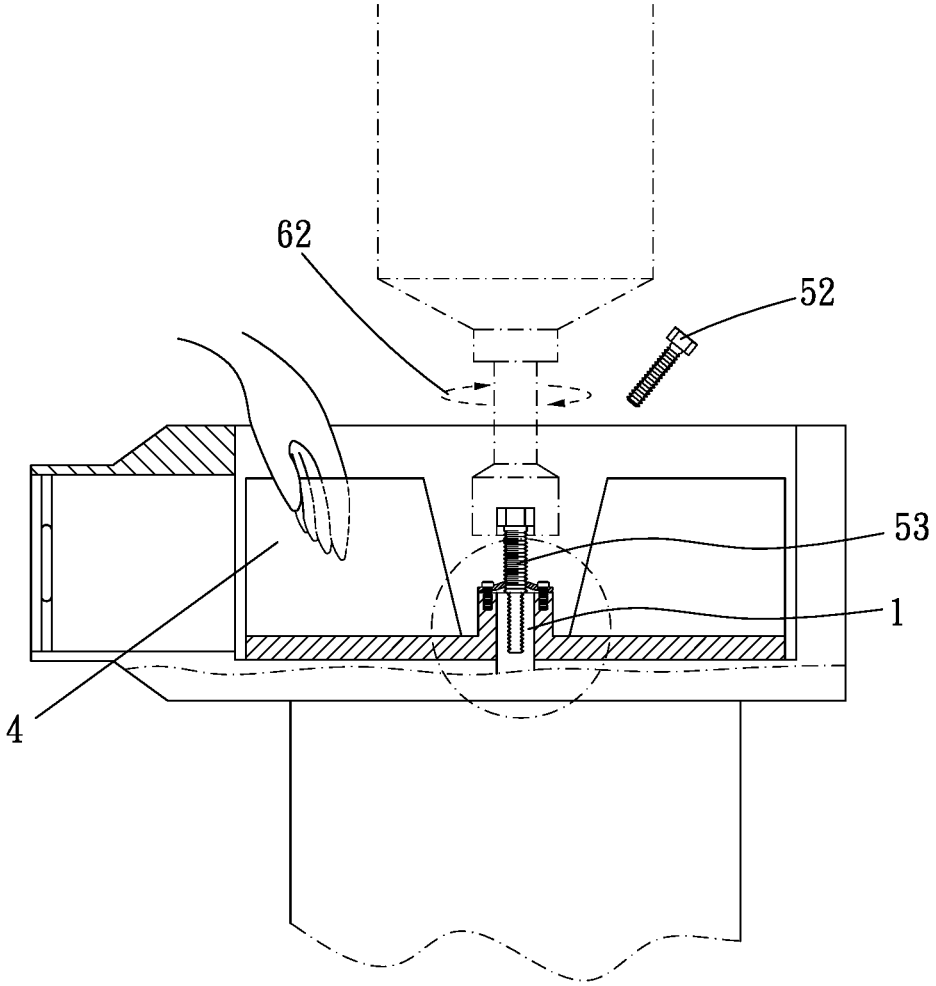
FIG. 9 is a drawing showing disassembling using a detachment bolt according to an embodiment of the present invention.
Figure 10:
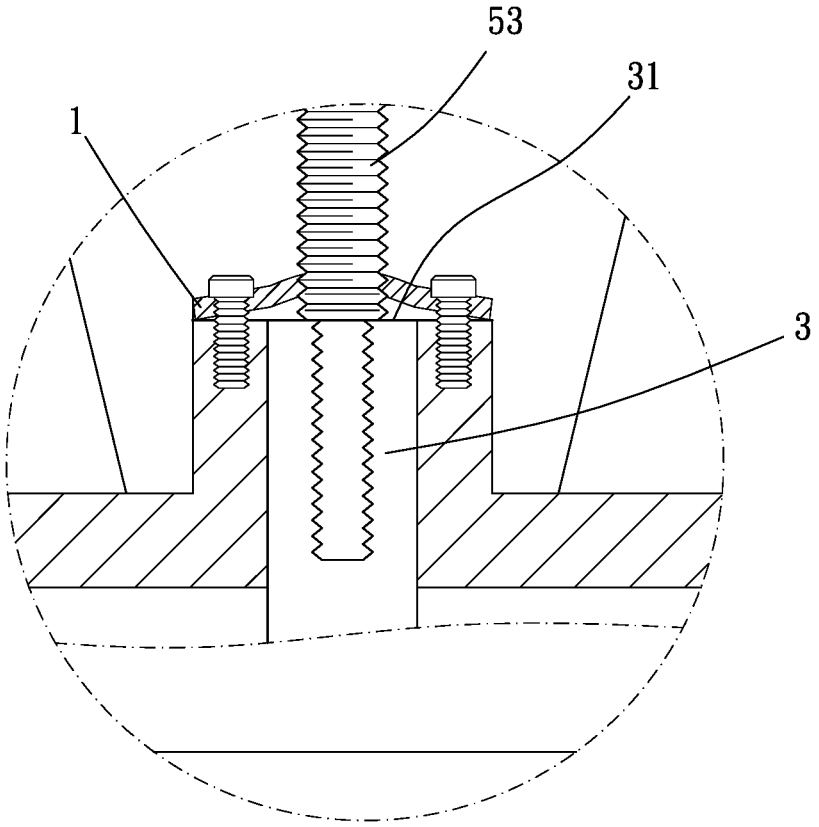
FIG. 10 is a partially-enlarged view of FIG. 9.
Figure 11:
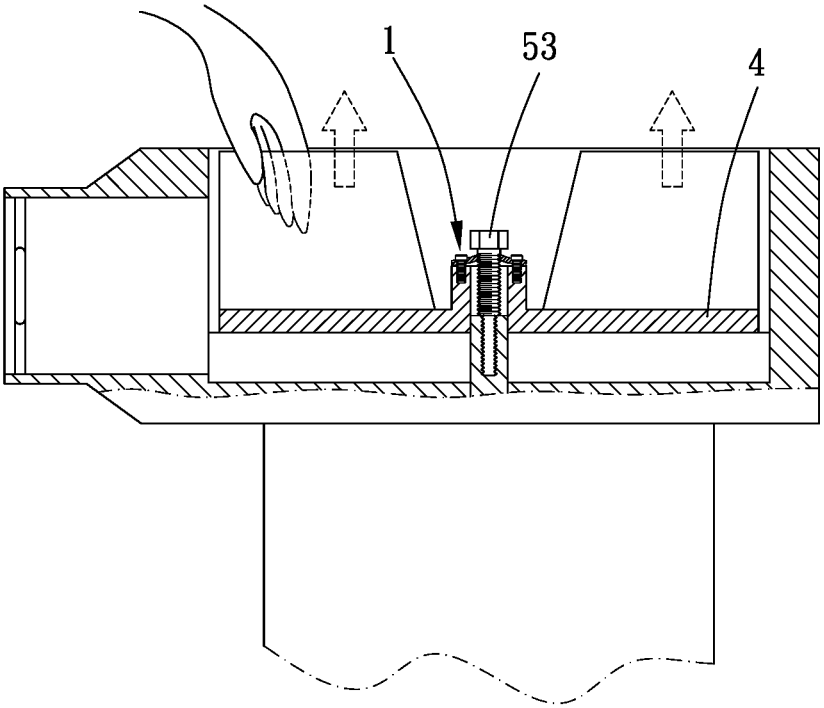
FIGS. 11 and 12 are drawings showing the blade assembly being detached from the rotating axle.
Figure 12:
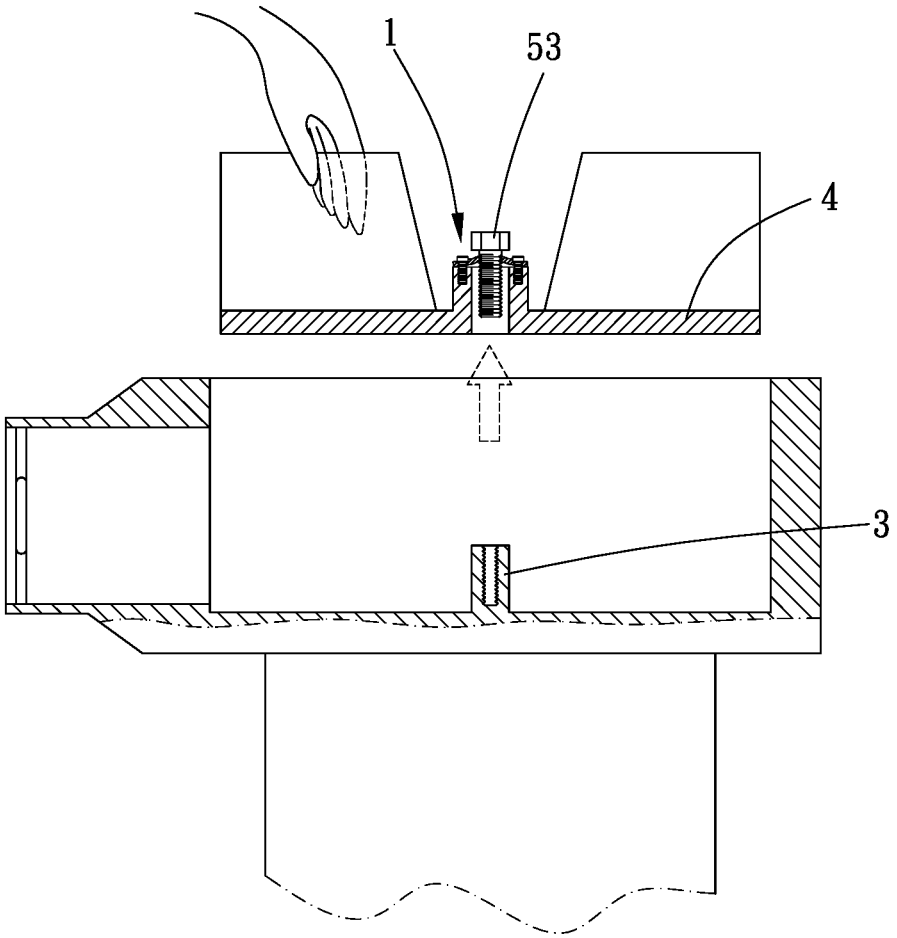

Please refer to FIGS. 1 and 12 for an embodiment, a detachment mechanism for a fan 1 for being adapted to a fan structure 2, the fan structure 2 includes a rotating axle 3 and a blade assembly 4, the rotating axle 3 defines an extension direction 61, the blade assembly 4 is detachably sleeved on the rotating axle 3 along the extension direction 61, and the blade assembly 4 and the rotating axle 3 are in a co-rotation relationship.

The detachment mechanism for the fan 1 is positionably connected to the blade assembly 4 and covers a part of the rotating axle 3, specifically, the detachment mechanism for the fan 1 includes a detachment threaded hole 11, the detachment threaded hole 11 is configured for a detachment bolt 53 to be rotatably screwed therewith, the detachment threaded hole 11 penetrates through the detachment mechanism for the fan 1 along the extension direction 61, and a part of the rotating axle 3 is exposed from an opening area of the detachment threaded hole 11. During a disassembling process, when the rotating axle 3 and the blade assembly 4 are not connected to other connecting members, the detachment bolt 53 is screwed with the detachment threaded hole 11 and abutted against the rotating axle 3 and the blade assembly 4 is kept in a non-rotating state, the detachment bolt 53 is driven to rotate continuously in a detachment direction 62 so that the detachment bolt 53 cannot move forward on the extension direction 61, so the detachment mechanism for the fan 1 moves along a direction in which the detachment bolt 53 moves away from the rotating axle 3, and the blade assembly 4 is driven to be detached from the rotating axle 3 to quickly disassemble the blade assembly 4.

Specifically, the rotating axle 3 includes a first end face 31 and a connection threaded hole 32, the connection threaded hole 32 is on the first end face 31, the detachment threaded hole 11 is configured to communicate with the connection threaded hole 32 on the extension direction 61, the detachment threaded hole 11 is greater than the connection threaded hole 32 in diameter so that the connection threaded hole 32 and a part of the first end face 31 are exposable from the opening area of the detachment threaded hole 11, a body portion 522 of a connection bolt 52 is configured to be disposed through the detachment threaded hole 11 to be screwed with the connection threaded hole 32 (a radial dimension of the body portion 522 is smaller than a diameter of the detachment threaded hole 11), a head portion 521 of the connection bolt 52 interferes with the detachment mechanism for the fan 1 on the extension direction 61, and the detachment mechanism for the fan 1 is connected to both the rotating axle 3 and the blade assembly 4; wherein the detachment threaded hole 11 is configured for the connection bolt 52 or the detachment bolt 53 to be disposed therethrough.

With the above-mentioned structure, the detachment mechanism for the fan 1 is dual-purpose and includes a connection mode and a detachment mode. Specifically, when the detachment mechanism for the fan 1 is used with the connection bolt 52, it is in the connection mode. In the connection mode, the detachment mechanism for the fan 1 can increase a connection between the blade assembly 4 and the rotating axle 3 to ensure there is preferable rotation stability between the blade assembly 4 and the rotating axle 3. When the connection bolt 52 is detached, the detachment bolt 53 is screwed with the detachment threaded hole 11 of the detachment mechanism for the fan 1, it is in the detachment mode, so the user can conduct the detachment operation of the blade assembly 4. More specifically, the detachment threaded hole 11 can be screwed with the connection bolt 52 or the detachment bolt 53 to produce two functions, the user can switch between the two modes only by using the connection bolt 52 or the detachment bolt 53 alternatively. Therefore, it is convenient and quick to use the detachment mechanism for the fan 1, and the user does not need to purchase a detachment tool additionally.

Preferably, the detachment threaded hole 11 is configured to be arranged coaxially with the connection threaded hole 32 for better processing operation and structure configuration. In addition, the coaxial structure is symmetrical, so when in the detachment mode, the detachment bolt 53 can uniformly push the first end face 31 from an exterior side of the connection threaded hole 32.

More preferably, the detachment mechanism for the fan 1 is disc-shaped and warps toward a side, so the detachment mechanism for the fan 1 has a protrusive side 13 and a recessed side 14, and the recessed side 14 faces the rotating axle 3 and abuts against the blade assembly 4. When in the connection mode, the detachment mechanism for the fan 1 which is warped can lead a pressing force of the connection bolt 52 to uniformly and concentratively press the blade assembly 4 to elevate the connection stability, and the detachment mechanism for the fan 1 has greater loading capacity to take a greater force from the connection bolt 52.

In this embodiment, the detachment mechanism for the fan 1 is made of metal, and a thickness of the detachment mechanism for the fan 1 is at least 3 mm to provide enough structure strength. In addition, a ratio of a greatest distance between the protrusive side 13 and the recessed side 14 to a thickness of the detachment mechanism for the fan 1 is between 1.5 and 5 to make the detachment mechanism for the fan 1 to warp properly.

It is to be noted that an axle sleeve 41 of the blade assembly 4 includes an axle hole 42, a second end face 43 and at least one positioning threaded hole 45, the axle hole 42 extends from the second end face 43 along the extension direction 61 for the rotating axle 3 to be inserted therein, the at least one positioning threaded hole 45 is on the second end face 43, when the blade assembly 4 is sleeved on the rotating axle 3, the second end face 43 and the first end face 31 are on a same side. The detachment mechanism for the fan 1 further has at least one through hole 12, the at least one through hole 12 is configured for correspondingly communicating with the at least one positioning threaded hole 45, and one said through hole 12 is configured for a positioning threaded member 54 to be disposed therethrough to be screwed with one said positioning threaded hole 45 so as to position the detachment mechanism for the fan 1 on the second end face 43. In this embodiment, the detachment mechanism for the fan 1 has two through holes 12, two said through holes 12 are symmetrically on two sides of the detachment threaded hole 11 relative to each other, and each said through hole 12 is smaller than the detachment threaded hole 11 in diameter.

The steps of using the detachment mechanism for the fan 1 are as follows. First, the detachment mechanism for the fan 1 is positionably connected to the blade assembly 4, and a part of the rotating axle 3 is exposed from the opening area of the detachment threaded hole 11. Second, the detachment bolt 53 is screwed with the detachment threaded hole 11 and abutted against the rotating axle 3 and the blade assembly 4 is kept in a non-rotating state. Finally, the detachment bolt 53 is driven to rotate continuously in a detachment direction 62, the detachment mechanism for the fan 1 moves along a direction in which the detachment bolt 53 moves away from the rotating axle 3, and the blade assembly 4 is driven to be detached from the rotating axle 3.

To be more specific about the structure of the fan structure 2, the fan structure 2 includes the detachment mechanism for the fan 1 and further includes the rotating axle 3, the blade assembly 4 and the connection bolt 52.

Specifically, the rotating axle 3 and the blade assembly 4 are connected to each other as follows: the rotating axle 3 has a first key slot 33 perpendicular to the extension direction 61, an axle sleeve 41 of the blade assembly 4 includes an axle hole 42 and a second key slot 44 which are perpendicular to the extension direction 61 and communicate with each other, after the rotating axle 3 is inserted into the axle hole 42 along the extension direction 61, the first and second key slots 33, 44 communicate with each other face to face, a key body 51 is engaged with the first and second key slots 33, 44 to make the rotating axle 3 and the blade assembly 4 to be in a co-rotation relationship.

The connection bolt 52 includes the head portion 521 and the body portion 522, the radial dimension of the body portion 522 is smaller than the diameter of the detachment threaded hole 11, the body portion 522 is disposed through the detachment threaded hole 11 to be positionably screwed with the connection threaded hole 32, and the head portion 521 abuts against the detachment mechanism for the fan 1 on the extension direction 61 to make the detachment mechanism for the fan 1 and the blade assembly 4 positionably connected to the rotating axle 3.

The fan structure 2 further includes the detachment threaded hole 11, to make the blade assembly 4 detached from the rotating axle 3, after the connection bolt 52 is rotated out of the detachment threaded hole 11, the detachment bolt 53 is controlled to be rotatably screwed with the detachment threaded hole 11 and abutted against the first end face 11, the detachment bolt 53 is driven to rotate continuously in the detachment direction 62, the detachment mechanism for the fan 1 moves along the direction in which the detachment bolt 53 moves away from the first end face 31, and the blade assembly 4 is driven to be detached from the rotating axle 3. A ratio of a radial dimension of the detachment bolt 53 to a radial dimension of the connection bolt 52 is between 1.2 and 1.5, so the user can clearly distinguish between the detachment bolt 53 and the connection bolt 52 and ensure the detachment bolt 53 and the rotating axle 3 contact each other for a sufficient area.

Given the above, the detachment mechanism for the fan, the usage of the detachment mechanism for the fan and the fan structure including the detachment mechanism for the fan are revolutionary, when the detachment mechanism for the fan is not being used, both the detachment mechanism for the fan and the blade assembly can fixedly positioned on the rotating axle via the connection bolt to co-rotate. When the user wants to disassemble the blade assembly, s/he only needs to replace the connection bolt with the detachment bolt, screw the detachment bolt with the detachment threaded hole and continuously rotate along the detachment direction, and then the detachment mechanism for the fan and the blade assembly can be detached from the rotating axle. The whole disassembling process is largely simplified.

While we have shown and described various embodiments in accordance with the present invention, it should be clear to those skilled in the art that further embodiments may be made without departing from the scope of the present invention.

What is claimed is:

1. A detachment mechanism for a fan, the fan including a rotating axle and a blade assembly, the rotating axle defining an extension direction, the blade assembly being detachably sleeved on the rotating axle, the blade assembly and the rotating axle being in a co-rotation relationship, the detachment mechanism for the fan being positionably connected to the blade assembly and covering a part of the rotating axle, the detachment mechanism for the fan including:

a detachment threaded hole, the detachment threaded hole being for a detachment bolt to be rotatably screwed therewith, the detachment threaded hole penetrating through the detachment mechanism for the fan along the extension direction, a second part of the rotating axle being exposed from an opening area of the detachment threaded hole; wherein, when the detachment bolt is screwed with the detachment threaded hole and abutted against the rotating axle and the blade assembly is kept in a non-rotating state, the detachment bolt is driven to rotate continuously in a detachment direction, the detachment mechanism for the fan moves away from the rotating axle along a direction in which the detachment bolt moves away from the rotating axle, and the blade assembly is driven to be detached from the rotating axle;

wherein the second part of the rotating axle includes a first end face and a connection threaded hole, the connection threaded hole is on the first end face, the detachment threaded hole is configured to communicate with the connection threaded hole in the extension direction, the detachment threaded hole is greater than the connection threaded hole in diameter such that the connection threaded hole and the second part including the first end face are exposable from the opening area of the detachment threaded hole, a body portion of a connection bolt is configured to be disposed through the detachment threaded hole to be screwed with the connection threaded hole, a head portion of the connection bolt interferes with the detachment mechanism for the fan in the extension direction, and the detachment mechanism for the fan is connected to both the rotating axle and the blade assembly; wherein the detachment threaded hole is configured for the connection bolt or the detachment bolt to be disposed therethrough.

2. The detachment mechanism for the fan of claim 1, wherein the detachment threaded hole is configured to be arranged coaxially with the connection threaded hole.

3. The detachment mechanism for the fan of claim 2, wherein an axle sleeve of the blade assembly includes an axle hole, a second end face and at least one positioning threaded hole, the axle hole extends from the second end face along the extension direction and is configured for the rotating axle to be inserted into, the at least one positioning threaded hole is on the second end face, and when the blade assembly is sleeved to the rotating axle, the second end face and the first end face are on a same side; the detachment mechanism for the fan further has at least one through hole, the at least one through hole is configured for correspondingly communicating with the at least one positioning threaded hole, and said at least one through hole is configured for a positioning threaded member to be disposed therethrough to be screwed with said at least one positioning threaded hole to position the detachment mechanism for the fan on the second end face; the detachment mechanism for the fan is disc-shaped and is warped such that the detachment mechanism for the fan has a protrusive side and a recessed side, and the recessed side faces the rotating axle and abuts against the blade assembly; the detachment mechanism for the fan has two through holes, the two through holes are arranged symmetrically on two sides of the detachment threaded hole relative to each other, and each said through hole is smaller than the detachment threaded hole in diameter; a thickness of the detachment mechanism for the fan is at least 3 mm; the detachment mechanism for the fan is made of metal; a ratio of a greatest distance between the protrusive side and the recessed side to the thickness of the detachment mechanism for the fan is between 1.5 and 5; a ratio of a radial dimension of the detachment bolt to a radial dimension of the connection bolt is between 1.2 and 1.5; the rotating axle has a first key slot perpendicular to the extension direction, the axle sleeve of the blade assembly includes a second key slot that is perpendicular to the extension direction, wherein the rotating axle is inserted into the axle hole along the extension direction and the first and second key slots align with each other such that a key body is engaged with the first and second key slots to make the rotating axle and the blade assembly be in a co-rotation relationship.

4. The detachment mechanism for the fan of claim 1, wherein the detachment mechanism for the fan is made of metal.

5. The detachment mechanism for the fan of claim 1, wherein a thickness of the detachment mechanism for the fan is at least 3 mm.

6. A detachment mechanism for a fan, the fan including a rotating axle and a blade assembly, the rotating axle defining an extension direction, the blade assembly being detachably sleeved on the rotating axle, the blade assembly and the rotating axle being in a co-rotation relationship, the detachment mechanism for the fan being positionably connected to the blade assembly and covering a part of the rotating axle, the detachment mechanism for the fan including:

a detachment threaded hole, the detachment threaded hole being for a detachment bolt to be rotatably screwed therewith, the detachment threaded hole penetrating through the detachment mechanism for the fan along the extension direction, a second part of the rotating axle being exposed from an opening area of the detachment threaded hole; wherein, when the detachment bolt is screwed with the detachment threaded hole and abutted against the rotating axle and the blade assembly is kept in a non-rotating state, the detachment bolt is driven to rotate continuously in a detachment direction, the detachment mechanism for the fan moves away from the rotating axle, and the blade assembly is driven to be detached from the rotating axle;

wherein an axle sleeve of the blade assembly includes an axle hole, a second end face and at least one positioning threaded hole, the axle hole extends from the second end face along the extension direction and is configured for the rotating axle to be inserted therein, the at least one positioning threaded hole is on the second end face, and when the blade assembly is sleeved on the rotating axle, the second end face and the first end face are on a same side; the detachment mechanism for the fan further has at least one through hole, the at least one through hole is configured for correspondingly communicating with the at least one positioning threaded hole, and said at least one through hole is configured for a positioning threaded member to be disposed therethrough to be screwed with said at least one positioning threaded hole to position the detachment mechanism for the fan on the second end face.

7. A detachment mechanism for a fan, the fan including a rotating axle and a blade assembly, the rotating axle defining an extension direction, the blade assembly being detachably sleeved on the rotating axle, the blade assembly and the rotating axle being in a co-rotation relationship, the detachment mechanism for the fan being positionably connected to the blade assembly and covering a part of the rotating axle, the detachment mechanism for the fan including:

a detachment threaded hole, the detachment threaded hole being for a detachment bolt to be rotatably screwed therewith, the detachment threaded hole penetrating through the detachment mechanism for the fan along the extension direction, a second part of the rotating axle being exposed from an opening area of the detachment threaded hole; wherein, when the detachment bolt is screwed with the detachment threaded hole and abutted against the rotating axle and the blade assembly is kept in a non-rotating state, the detachment bolt is driven to rotate continuously in a detachment direction, the detachment mechanism for the fan moves away from the rotating axle, and the blade assembly is driven to be detached from the rotating axle;

wherein the detachment mechanism for the fan is disc-shaped and is warped, such that the detachment mechanism for the fan has a protrusive side and a recessed side, and the recessed side faces the rotating axle and abuts against the blade assembly.

8. The detachment mechanism for the fan of claim 7, wherein a ratio of a greatest distance between the protrusive side and the recessed side to a thickness of the detachment mechanism for the fan is between 1.5 and 5.

* * * * *